US008680953B2

(12) United States Patent
Arregui Padilla et al.

(10) Patent No.: US 8,680,953 B2
(45) Date of Patent: Mar. 25, 2014

(54) LOW-PASS FILTER FOR ELECTROMAGNETIC SIGNALS

(75) Inventors: Iván Arregui Padilla, Pamplona (ES); Israel Arnedo Gil, Pamplona (ES); José María Lopetegui Beregaña, Pamplona (ES); Miguel Ángel Gómez Laso, Pamplona (ES); José Antonio Marcotegui Iturmendi, Aizoain (ES)

(73) Assignee: Tafco Metawireless, S.L.

( * ) Notice: Subject to any disclaimer, the term of this patent is extended or adjusted under 35 U.S.C. 154(b) by 654 days.

(21) Appl. No.: 12/863,354

(22) PCT Filed: Jan. 21, 2009

(86) PCT No.: PCT/ES2009/000028

§ 371 (c)(1),
(2), (4) Date: Jul. 16, 2010

(87) PCT Pub. No.: WO2009/092838

PCT Pub. Date: Jul. 3, 2009

(65) Prior Publication Data

US 2010/0308938 A1 Dec. 9, 2010

(30) Foreign Application Priority Data

Jan. 21, 2008 (ES) ..... 200800127

(51) Int. Cl.
*H01P 1/211* (2006.01)

(52) U.S. Cl.
CPC ..... *H01P 1/211* (2013.01)
USPC ..... 333/208

(58) Field of Classification Search
CPC ..... H01P 1/211
USPC ..... 333/204, 205, 208, 209
See application file for complete search history.

(56) References Cited

U.S. PATENT DOCUMENTS

| | | | | |
|---|---|---|---|---|
| 6,285,267 | B1 * | 9/2001 | Hauth et al. | 333/210 |
| 7,468,641 | B2 * | 12/2008 | Sorolla et al. | 333/135 |
| 2007/0024394 | A1 | 2/2007 | Sorolla et al. | |

OTHER PUBLICATIONS

Arnedo, I.; Gil, J, I.; Ortiz, N; Lopetegi, T.; Laso, M.A.G.; Thumm, M.; Sorolla, M.; Schmitt, D. Guglielmi, M.: "Spurious removal in satellite output multiplexer power filters": Microwave Conference, 2007. European Oct. 9-12, 2007 pp. 67-70.

Arendo, I.; Arregui, I.; Falcone, F.J.; Laso, M. A.G.; Lopetegi, T.: "Low Pass Filter with Wide Rejection Band in Microstrip Technology": Signals, Systems and Electronics, 2007. Issue' 07. International Symposium on Jul. 30-Aug. 2, 2007 pp. 13-16.

* cited by examiner

*Primary Examiner* — Benny Lee
*Assistant Examiner* — Gerald Stevens
(74) *Attorney, Agent, or Firm* — Lucas & Mercanti, LLP

(57) ABSTRACT

The invention relates to a low-pass filter for electromagnetic signals, made up of a series of rejection elements defined by stubs (2) of length $\lambda_g/4$, with a small or zero distance between them, these elements being tuned to different frequencies determining the rejection band.

4 Claims, 3 Drawing Sheets

LOW-PASS FILTER FOR ELECTROMAGNETIC SIGNALS

This is a U.S. National Phase Application under 35 U.S.C. 371 of International Application PCT/ES2009/000028, filed on Jan. 21, 2009.

This Application claims the priority of Japanese Application No. P200800127, filed Jan. 21, 2008, the entire content of which is hereby incorporated by reference.

FIELD OF THE ART

The present invention relates to the treatment of electromagnetic signals, proposing a low-pass filter in a waveguide or transmission line with a large rejection bandwidth and with design features which allow high power and reduced length of the device.

STATE OF THE ART

There are waveguide and transmission line techniques for designing devices for treating the frequency of electromagnetic signals (Microwave filters, impedance-matching networks and coupling structures; Matthai, Young and Jones; Artech House 1980, chapters 9 and 12), among which the following types of devices can be pointed out:

- Band-pass filters, based on the use of stubs of length $\lambda_g/2$ (where $\lambda_g$ is the phase velocity divided by the design frequency) with $\lambda_g/4$ separation between them (Waveguide components for Antenna Feed Systems: Theory and CAD; Uher, Bornemann and Rosemberg; Artech House 1993, pp. 185-189).
- Band-rejection filters, based on the use of stubs of length $\lambda_g/4$ with $\lambda_g/4$ separation between them (Waveguide components for Antenna Feed Systems: Theory and CAD; Uher, Bornemann and Rosemberg; Artech House 1993, pp. 185-189).
- Waveguide corrugated-type low-pass filters (Waveguide components for Antenna Feed Systems: Theory and CAD; Uher, Bornemann and Rosemberg; Artech House 1993, pp. 200-207). Said filters are structured as deformations or corrugations of the tubular wall of the filter. Although these filters are referred to as low-pass, all waveguide filters have the particularity that they only allow the transmission of signals the frequency of which is greater than a determined frequency, referred to as cut-off frequency. For the specific case of the waveguide having a rectangular section, this cut-off frequency is determined (analytically) by the width of the guide. For that reason, even the so-called waveguide low-pass filters have a band-pass performance, such that the lower frequency of the passband is controlled by varying the cut-off frequency of the guide.

The main problem of low-pass filters designed with the classic corrugated filter techniques is that the low-pass response is maintained as long as there is single-mode performance, i.e., when only the fundamental mode, which is the first of those which can be propagated through the waveguide, is propagated through the filter.

Therefore, if high frequencies are to be rejected in waveguides having a rectangular section (for example up to the third harmonic of the passband), it is only possible to do this with more complex filters such as waffle-iron filters (described for example in patent U.S. Pat. No. 6,285,267), and specifically designed for it. However, the waffle-iron designs require the presence of very small physical gaps (height separation between the walls of the guide on the inside) such that only a reduced amount of power can pass through them. Furthermore, these waffle-iron filters need to have a relatively long length in order to obtain an abrupt transition between the passband (range of frequencies that can pass through the guide) and the rejection band (range of frequencies that the guide does not let pass through).

In this sense, patent US 2007024394 describes a device that is formed from a high-power corrugated low-pass filter (which does not allow rejecting up to the third harmonic), at the output of which there is added a structure based on the Bragg reflection phenomenon (said phenomenon explains that it is possible to reject a frequency with a suitable period in the perturbation that is performed in the guide). It is thus possible to reject up to the third harmonic, the same that could be achieved with a waffle-iron design but with a high enough gap in the entire structure so as to allow the passage of a large amount of power. However, the concatenation of the two structures generally leads to very long devices. In this sense, although it is possible to consider rejecting the low frequencies also with Bragg reflection and dispensing with the corrugated filter, the period that would have to be used in the Bragg structure would be long and, in order to preserve good frequency features with a sufficient number of periods, the length of the structure Bragg would have to be very large.

OBJECT OF THE INVENTION

According to the invention, a low-pass filter with a large rejection bandwidth and with design features that allow a high power and a reduced length of the device is proposed.

This filter object of the invention is preferably structured according to a tubular guide having a rectangular section, in which a continuous series of rejection elements (stop elements) are determined, preferably using stubs (sections of guide transverse to the propagation direction) of length $\lambda_g/4$ with no separation between them along the propagation direction, such that on said series of stubs a windowing is applied the function of which is geometrically defined by the series of the maximums of the stubs (outer envelope) and by the series of the minimum gaps of said stubs (inner envelope).

In the embodiment of the filter, three structurally differentiated areas are determined through the guide, in one of which, corresponding to the inlet end of the filter, the inner envelope progressively decreases, whereas the outer envelope progressively increases very slightly. In the second area, corresponding to the intermediate part of the length, the inner envelope remains constant, whereas the outer envelope progressively increases considerably. And in the third area, corresponding to the outlet end of the filter, the inner envelope progressively increases, whereas the outer envelope progressively decreases very considerably.

The stubs are preferably sinusoidal because optimal features of the filter in its functional performance are thus obtained. However, other shapes (rectangular, triangular or even one defined at points) are also possible for the stub provided that they function like a rejection element.

Good return losses in the passband (due to the progressive windowing and to the smooth topology of the stubs), a very abrupt slope between the passband and the rejection band (due to the use of the $\lambda_g/4$ stubs) and a very small total length of the device (due to the fact that there is no separation between the stubs) are obtained with the low-pass filter of the invention.

This filter furthermore allows rejecting frequencies up to the third harmonic of the passband, and at the same time has smooth profiles with a minimum gap that is large enough to allow the passage of a large amount of power. Furthermore, if power is not a requirement, the device can be designed in a still more compact manner.

As a result, said filter object of the invention has certainly advantageous features, acquiring its own identify and preferred character with respect to conventional filters of the same application.

DETAILED DESCRIPTION OF THE INVENTION

The object of the invention relates to a waveguide low-pass type filter intended for the treatment of electromagnetic signals, for the purpose of limiting the passage of said signals in a determined frequency band. In addition to blocking the passage at frequency ranges in which other proposals have failed, with the proposed filter very important practical use features are simultaneously preserved, such as the compact size or the possibility of handling high power.

Figure 1:
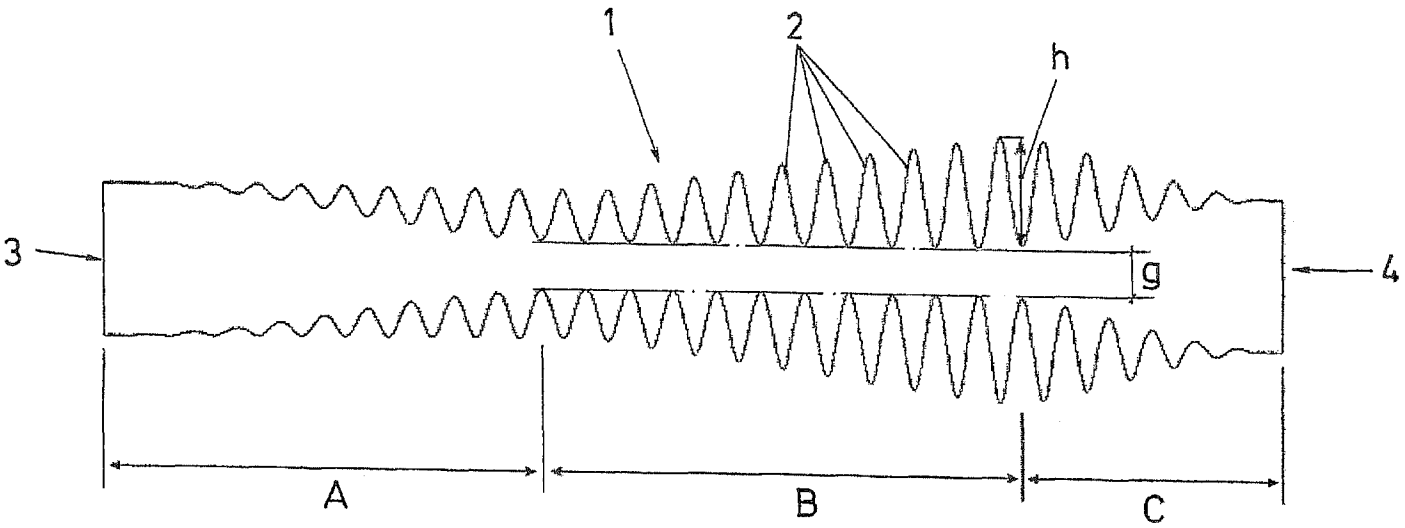
FIG. 1 shows a in a schematic longitudinal section view an embodiment of the proposed filter.
Figure 2:
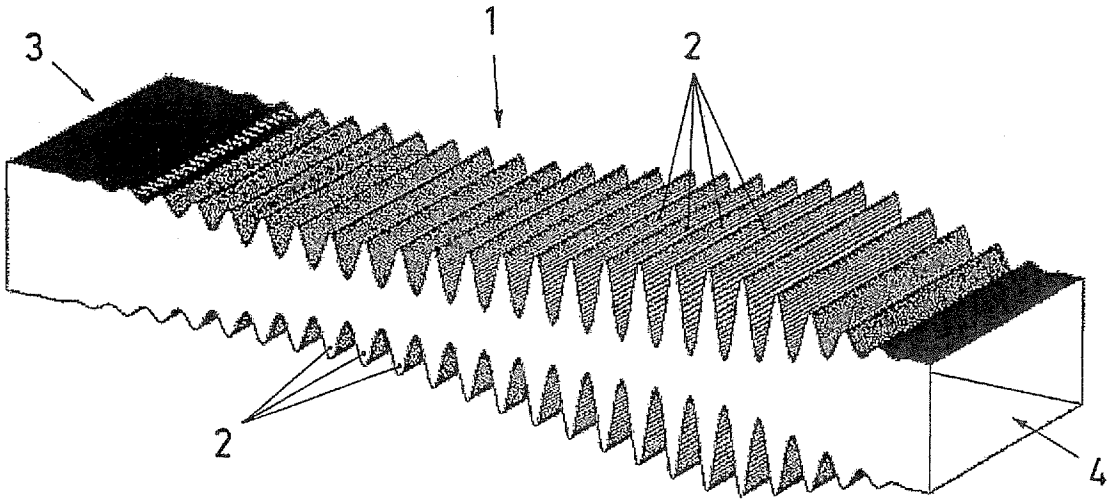
FIG. 2 is a perspective depiction of the filter of the previous figure.

This filter object of the invention, as depicted in FIGS. 1 and 2, consists of a metal guide (1) having a rectangular tubular shape, in the upper and lower walls of which there is longitudinally defined a perturbation with conformations (stubs) having a sinusoidal profile (2), accordingly facing one another, which act as rejection elements.

When a low-pass filter such as the one of the invention is designed, the type of guide that is used is determined by the specific application. A waveguide having a rectangular section will generally be used, although waveguides having a circular section or more complex sections, such as the ridge guide for example, could also be used. It will also be possible to use transmission lines, such as coaxial, microstrip, stripline transmission lines, etc.

Said stubs (2) of the walls of the guide (1) are defined continuously without any separation between them, each of these stubs (2) being of length ($h=\lambda_g/4$) between the crest and the bottom, where $\lambda_g$ is the phase velocity divided by the design frequency.

Determined on the mentioned stubs (2) there is a variable profile configuration, typically defining in the longitudinal assembly of the guide (1) three differentiated areas (A, B, C), such that:

- In area (A), corresponding to the inlet end of the filter, the inner envelope progressively decreases, whereas the outer envelope progressively increases.
- In area (B), corresponding to the intermediate area of the length, the inner envelope remains constant, whereas the outer envelope progressively increases considerably.
- And in area (C), corresponding to the outlet end of the filter, the inner envelope progressively increases, whereas the outer envelope progressively decreases very considerably.

In this disposition, each stub (2) reflects a frequency that is determined by the length of these rejection elements, such that with the variation of their different heights, the stubs (2) of the guide (1) allow rejecting different frequencies, preventing their propagation through the structure of the filter. Furthermore, this rejection frequency can also be modified by varying the relative position of the stub with respect to the height of the guide port, and the width of the base of the stub (distance between two minimum consecutive gaps).

A filter can thus be configured with a wide rejection band which allows eliminating all the frequencies up to the third harmonic of the passband and which can even reject higher frequencies. Furthermore, the invention at the same time has a minimum gap (g) that is high enough and smooth profiles to allow the passage of a large amount of power. All this is achieved with a reduced total length in comparison with other available solutions.

The intermediate area (B) of the longitudinal assembly of the filter is made up of a series of stubs (2) of different lengths (h), which cause the rejection of different frequencies, determining the rejection band of the filter. The distribution of the stubs forming the intermediate part of this device is determined by the specifications of the rejection band to be achieved.

The end areas (A and C) in turn define windowed sectors of stubs (2), which allow obtaining good return losses in the passband (low reflection towards the inlet port), while at the same time they allow reaching standard heights at the inlet port (3) and outlet port (4) of the filter, for coupling to other systems. This windowing will correspond to the specifications of the passband, therefore being able to be Gaussian, Kaiser, Hanning, Hamming type, etc.

Although for this specific case the final device is defined by the areas (A, B and C), this is particular for the chosen frequency response. However, there can be other frequency responses for which the distribution of the rejection elements can be different, resulting in a device in which the previously mentioned areas may not be as clearly differentiable. Therefore, as a result of the application of this technique, an arbitrary distribution of the maximums and of the minimums of the stubs (2) can occur through the device.

The sinusoidal configuration of the stubs (2) symmetrical with respect to the axis of propagation is preferred, also being able to adopt other similar configurations, such as rectangular shaped (with or without steps), triangular shaped, or any arbitrary shape can even be defined, provided that they function like a rejection element. Furthermore, any of these rejection elements can also be used in an asymmetrical manner, i.e., the distribution of lengths of the stubs (2) of the upper part does not match with the lower part, even being able to dispense with the stubs (2) in one of them.

Likewise, the separation between the rejection elements will preferably be zero. If this is not possible due to the shape of the stubs (2) or to other design requirements, the distance between them should be small enough so as to obtain a compact device.

The frequency response of the filters is defined from their reflection coefficient and their transmission coefficient, the reflection coefficient being the ratio between the power introduced in the filter through the inlet port (3) and the power received in the inlet port (3) itself due to the reflections occurring in the device. The transmission coefficient is the ratio between the power introduced in the filter through the inlet port (3) and the power received in the outlet port (4).

Figure 3:
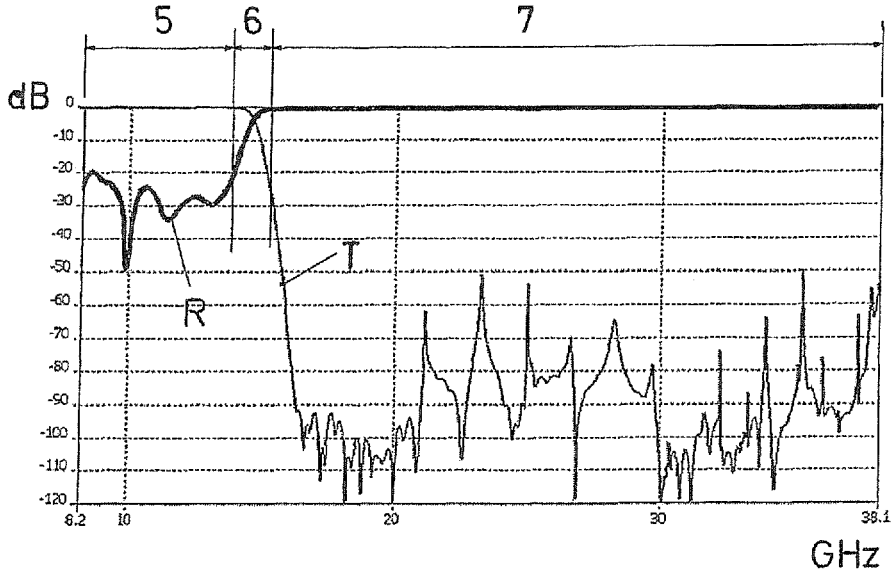
FIG. 3 is a graph of the frequency response of the proposed filter, including the reflection response and the transmission response.

FIG. 3 depicts the frequency performance of the filter made according to the shape of the invention, where line (R) corresponds to the reflection coefficient, wherein it is possible to observe that up to 12.5 GHz (gigahertz) at least 20 dB (decibels) less than what are introduced are reflected, i.e. very little reflection occurs; but after 16.4 GHz, the filter reflects virtually all the power that is introduced.

In the same conditions, the line (T) corresponds to the transmission coefficient, wherein it is possible to observe that up to 12.5 GHz, virtually all the power introduced reaches the outlet port (4), whereas after 16.4 GHz, 50 dB less than what are introduced are received in the outlet port, i.e., virtually all the power is rejected in the filter after that frequency.

The following parameters can therefore be appreciated in the frequency response of the filter:

Passband from 8.2 GHz to 12.5 GHz, corresponding to the frequency range of the area (5), such that the signals having a frequency included in this range can pass through the filter, this band being defined by very low insertion losses (approximately 0 dB) (determined by the transmission coefficient) and by very high return losses (around 20 dB) (determined by the reflection coefficient).

Rejection band from 16.4 GHz to 37.5 GHz, corresponding to the frequency range of the area (7), such that the signals having a frequency included in this range are rejected.

Transition band from 12.5 GHz to 16.4 GHz, corresponding to the frequency range of the area (6), and which is defined as the frequency range between the passband and the rejection band.

Ideally, a low-pass filter allows all the power to pass (zero insertion losses and infinite return losses) up to a frequency and right after that frequency it does not allow any power to pass (infinite insertion losses) such that the transition band in the ideal filter has a width of 0 Hz.

The invention claimed is:

1. A low-pass filter for electromagnetic signals, for limiting the passage of frequency ranges through a waveguide, characterized in that the waveguide or transmission line has a series of rejection elements, which are tuned to different frequencies determining a rejection band;

wherein the rejection elements are defined by stubs of length $\lambda_g/4$ and which have a sinusoidal, rectangular or any other arbitrary shape, being symmetrical or not with respect to a propagation direction;

the low-pass filter being further characterized in that:

the low-pass filter has the waveguide, wherein the waveguide has a rectangular section, and wherein upper and lower walls of the waveguide longitudinally define a perturbation of the rejection elements, having zero separation between them and accordingly facing one another, determining an inner envelope and an outer envelope which are variable, such that depending on a configuration of said inner and outer envelopes three consecutive longitudinal areas (A, B and C) having a different functional performance in relation to the electromagnetic signals passing through the inside of the waveguide are determined; and the longitudinal area (A) corresponding to an end inlet part of the filter is defined with the inner envelope which progressively decreases and with the outer envelope which progressively increases slightly.

2. The low-pass filter for electromagnetic signals according to claim 1, further characterized in that:

an intermediate one of the three longitudinal areas (B) is defined with the inner envelope that remains constant, and with the outer envelope which progressively increases considerably; and the longitudinal area (C) corresponding to an end outlet part of the filter is defined with the inner envelope which progressively increases and with the outer envelope which progressively decreases very considerably.

3. A low-pass filter for electromagnetic signals, for limiting the passage of frequency ranges through a waveguide, characterized in that the waveguide or transmission line has a series of rejection elements, which are tuned to different frequencies determining a rejection band;

wherein the rejection elements are defined by stubs of length $\lambda_g/4$ and which have a sinusoidal, rectangular or any other arbitrary shape, being symmetrical or not with respect to a propagation direction, the low-pass filter being further characterized in that:

the low-pass filter has the waveguide, wherein the waveguide has a rectangular section, and wherein upper and lower walls of the waveguide longitudinally define a perturbation of the rejection elements, having zero separation between them and accordingly facing one another, determining an inner envelope and an outer envelope which are variable, such that depending on a configuration of said inner and outer envelopes three consecutive longitudinal areas (A, B and C) having a different functional performance in relation to the electromagnetic signals passing through the inside of the waveguide are determined; and an intermediate one of the three consecutive longitudinal areas (B) is defined with the inner envelope that remains constant, and with the outer envelope which progressively increases considerably.

4. A low-pass filter for electromagnetic signals, for limiting the passage of frequency ranges through a waveguide, characterized in that the waveguide or transmission line has a series of rejection elements, which are tuned to different frequencies determining a rejection band;

wherein the rejection elements are defined by stubs of length $\lambda_g/4$ and which have a sinusoidal, rectangular or any other arbitrary shape, being symmetrical or not with respect to a propagation direction, the low-pass filter being further characterized in that:

the low-pass filter has the waveguide, wherein the waveguide has a rectangular section, and wherein upper and lower walls of the waveguide longitudinally define a perturbation of the rejection elements, having zero separation between them and accordingly facing one another, determining and inner envelope and an outer envelope which are variable, such that depending on a configuration of said inner and outer envelopes three consecutive longitudinal areas (A, B and C) having a different functional performance in relation to the electromagnetic signals passing through the inside of the waveguide are determined; and the longitudinal area (C) corresponding to an end outlet part of the filter is defined with the inner envelope which progressively increases and with the outer envelope which progressively decreases very considerably.

* * * * *